United States Patent [19]

van Leeuwen

[11] Patent Number: 4,470,903

[45] Date of Patent: Sep. 11, 1984

[54] APPARATUS FOR THE FLOTATION OF FLOCCULATED SOLID MATERIAL IN A LIQUID

[75] Inventor: Johannes van Leeuwen, Santpoort, Netherlands

[73] Assignee: ESMIL BV, Amsterdam, Netherlands

[21] Appl. No.: 241,256

[22] Filed: Mar. 6, 1981

[30] Foreign Application Priority Data

Mar. 7, 1980 [NL] Netherlands ..... 8001372

[51] Int. Cl.[3] ..... B03D 1/14

[52] U.S. Cl. ..... 209/168; 210/221.2

[58] Field of Search ..... 209/168, 170, 207; 210/220, 221.1, 221.2, 704–707

[56] References Cited

U.S. PATENT DOCUMENTS 2,330,589 9/1943 Juell ..... 210/221.2 X
3,286,844 11/1966 Juell ..... 209/170 X
3,769,207 10/1973 Baer ..... 210/221.2 X
4,230,561 10/1980 McMurray ..... 209/173 X

FOREIGN PATENT DOCUMENTS 930951 7/1963 United Kingdom ..... 210/704

*Primary Examiner*—Ralph J. Hill
*Attorney, Agent, or Firm*—Jon M. Lewis

[57] ABSTRACT

Flotation apparatus for flocculated solid material has a flotation tank alongside a passage for upward flow of liquid carrying the solid material. A wall of the passage on the side towards the tank has a top portion curved over to its free edge to provide a submerged weir over which the liquid passes from the passage into the tank. To prevent turbulence in the liquid on passing over the weir and to prevent a preferential flow path in the flotation tank, the tank itself has, on its side towards the upward flow passage, a side wall which is generally spaced from the side wall of the passage but joins the latter wall away from the said free edge. The tank side wall slopes downwardly away from the passage from a point located inwardly of the tank with respect to the free edge.

4 Claims, 3 Drawing Figures

APPARATUS FOR THE FLOTATION OF FLOCCULATED SOLID MATERIAL IN A LIQUID

BACKGROUND OF THE INVENTION

1. Field of the Invention

The present invention relates to apparatus for the flotation of flocculated solid material in a liquid. The solid material may for example be a sludge which is flocculated and rendered floatable in order to remove it from the liquid, e.g. in the treatment of waste water from industrial processes.

2. Description of the Prior Art

A known form of flotation apparatus (described in more detail below with reference to FIG. 1) has an upward flow passage adjacent a flotation tank. The side wall of this passage on the side towards the tank has an upper end which is curved over towards the tank and ends at a free edge, thus providing a submerged weir over which, in use, the liquid bearing the flocculated solid material ready for floating and collection passes from the upward flow passage into the flotation tank.

In this known apparatus, the solid material is flocculated in a flocculation or coagulation tank, which has a design such that the flocculated material is formed over its whole width and is fed into the upward flow passage across the whole width of this passage. To float the flocculated components, the flocculated material is carried up the upward flow passage to the surface of the liquid by small bubbles of gas or air. At the surface the flocculated particles should form a continuous layer which spreads out over the flotation tank. The liquid itself passes slowly through the flotation tank and can escape at the bottom thereof. The floating solids are removed by a skimming apparatus.

This general process of flocculation, flotation and skimming is well known and need not be described in this specification which is concerned with an improvement in one feature of the flotation step.

It should be noted that, to achieve good separation of solids and the liquid, it is important that the flocculated material is able to form as complete a layer as possible on the liquid surface and that this layer is affected as little as possible by the subsequent flow of the liquid in the flotation tank.

In this known apparatus, the vertical cross-section of the flotation tank is substantially rectangular and the upward flow passage and flotation tank are separated by a nearly vertical partition which directly separates the passage and the tank and at the top of which is the weir described above. Considerable turbulence in the flotation tank behind the overflow edge has been found unavoidable; as a result of this turbulence, a substantial fraction of the flocculated flotation material becomes mixed again with the liquid again and settles in the flotation tank. This fraction is then out of reach of the skimming mechanism, and contaminates the flotation tank. Also the effluent from the apparatus is significantly dirtier, because of this fraction.

DE No. 2 641 718 shows a flotation tank arrangement in which the side wall of the upward flow passage is straight, and is joined below its upper edge by a sloping side wall of the flotation tank. The performance of this arrangement is not known.

SUMMARY OF THE INVENTION

The object of this invention is to provide flotation apparatus in which turbulence at the weir is avoided or reduced, with the aim of preventing the disadvantageous phenomenon described above. Furthermore it is another object to provide such apparatus in which the liquid as far as possible flows downwardly uniformly over the whole area of the flotation tank, without a preferential flow route which might entrain the flocculated material.

The invention as claimed aims to achieve these objects.

In the present invention the edge of the wall of the upward flow passage is free while the flotation tank has a separate side wall which joins the wall of the upward flow passage at a point near, but speaced from and preferably below this free edge. This wall of the flotation tank has a portion which slopes downwards and away from that of the upward flow passage from a point beyond the free edge. This configuration prevents the formation of strong eddy currents in the liquid beyond the free edge, while a preferential uninterrupted downward stream of the liquid through the flotation tank directly from the upward flow passage is inhibited. This ensures that the flocculated material is not carried downwards in the flotation tank from the free edge as a result either of being mixed with the liquid again or of a strong narrow downward current. On the contrary, the liquid flowing out of the upward flow passage now first spreads slowly out over the surface in the flotation tank and the passes downwards in it at a fairly uniform rate. This gives the flocculated material which is carried up to the surface the maximum opportunity to form a continuous layer at the surface.

In particular, it has been found advantageous to have a configuration in which the sloping side wall of the flotation tank sloping downwardly at an angle of approximately 60° to the bottom of the tank and in which the top of this sloping wall portion is separated from the wall of the upward flow passage by a distance equal to approximately double the horizontal width of the weir.

It is important that the liquid flows downwards over the whole width of the flotation tank at a uniform rate. To prevent unwanted acceleration or deceleration of the liquid current it is preferred in the invention that the flotation tank has an essentially constant horizontal cross-sectional area over most of its depth.

BRIEF INTRODUCTION OF THE DRAWINGS

The preferred embodiment of the invention will now be described by way of non-limitative example, and compared with certain other configurations, with reference to the accompanying drawing, in which:

FIG. 1 is a diagrammatic side view of the flotation apparatus of a known type which was described above, FIG. 2 illustrates one possible variation (unpublished) of this known apparatus, and FIG. 3 is a diagrammatic side view of the preferred apparatus in accordance with the invention.

DESCRIPTION OF THE PREFERRED EMBODIMENT

Figure 1:
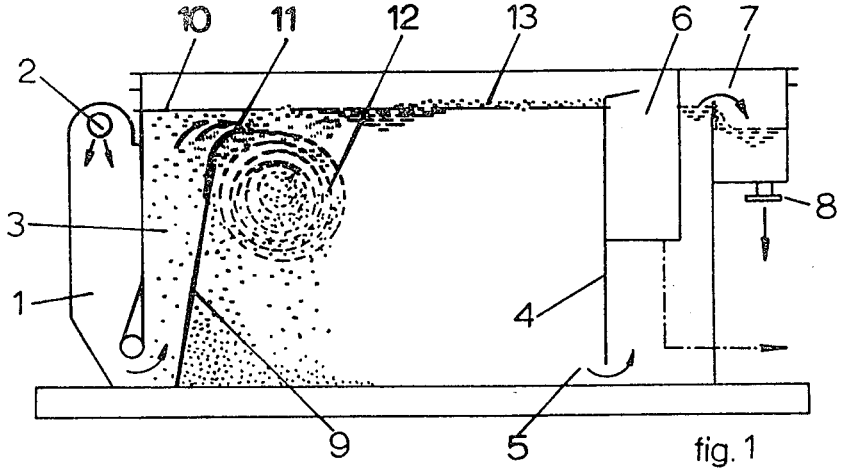
fig. 1 PRIOR ART

In the three figures of the drawing, the same reference numerals are used to designate corresponding elements of the three apparatuses illustrated.

FIG. 1 shows the known flotation system which has a downward passage or coagulation tank 1. Liquid containing suspended solid material flows in at the level 2 of this tank 1 and the suspended material is flocculated by the addition of a flocculating agent by a method which does not require description here.

Next to the coagulation tank 1 is an upward flow passage 3, into which the liquid and flocculated solid material then passes. Because the liquid is fed in at level 2 over the whole width of the coagulation tank and because the width of the latter is the same as that of the passage 3, there is a uniform flow of water and flocculated material across the width of the passage 3. A current of air bubbles is generated (in a manner which again need not be described) in the passage 3 and carries the flocculated material upwardly.

Next to the upward flow passage 3 is a flotation tank 4 which has an outlet 5 at the bottom through which the liquid can flow away, to pass over an overflow 7 and out through the drain pipe 8. The passage 3 and the flotation tank 4 are separated by the slightly inclined partion 9. Below the surface 10 of the liquid, the upper end of the partition 9 is curved over and ends in a free edge 11 to form a submerged weir across which the liquid flows into the flotation tank 4. The upwardly carried floatable flocculated mass is thus able to form a layer 13 at the surface of the liquid which can be collected by a skimmer (not shown) and removed via a drain 6. A known skimming mechanism can be used for this purpose.

As mentioned above, it has been found that rather violent turbulence is generated behind the edge 11 in the arrangement of FIG. 1, as indicated at 12 in the Figure. The result is that a substantial fraction of the flocculated material is mixed again with the liquid and a stable layer is unable to form at the liquid surface. Much of the re-mixed flocculated material settles in the tank 4 and gradually contaminates it, but part of it will also be carried through the opening 5 along with the effluent, with the result that the latter is not satisfactorily purified.

Figure 2:
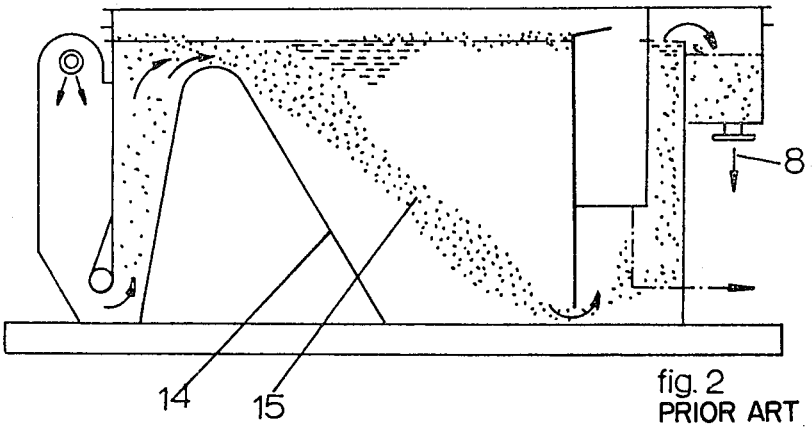
fig. 2 PRIOR ART

To try to remove the turbulence, in an unpublished proposal the wall 9 joins, through the curved over part 11, a downward sloping wall 14 which extends parallel to the current in the flotation tank. This is illustrated in FIG. 2. This certainly prevents the turbulence 12, but it has been found to produce a strong preferential or dominant current in the liquid flowing direct from the weir to the outlet 5. This preferential current is so strong that a substantial fraction of the flocculated material is carried downwards and away with the liquid.

Figure 3:
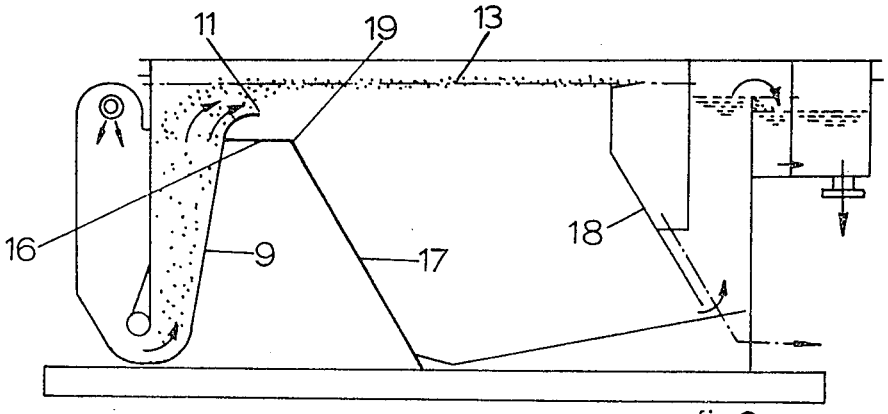

The apparatus of the invention illustrated in FIG. 3 solves this problem. The wall 14 of FIG. 2, which is continuous with the wall 9 of the upper flow passage 3 and is here replaced by a side wall of the tank 4 which is divided into a horizontal portion 16 and a sloping portion 17 joining at the line 19. The free edge 11 of FIG. 1 is still present, preventing the formation of a strong preferential current. The side wall 16,17 of the tank is generally spaced from the side wall 9 of the upward flow passage 3, but joins the latter wall at the left-hand end of the horizontal portion 16, at a line below the level of the free edge 11 and below the curved over end portion of the wall 9. The location of the join of the wall 9 and the wall 16,17 may be different from that shown, but it must be substantially spaced from the free edge 11 so as to allow the free edge to work effectively to suppress the preferential flow tendency. FIG. 3 also shows that the join line 9 of the two portions 16,17 is, as seen in plan view, located substantially inwardly of the tank 4 with respect to the free edge 11, i.e. as seen in FIG. 3 the point 19 is to the right of the free edge 11. FIG. 3 also shows that the line 19 is slightly more than twice as far, horizontally, from the join of the wall 9 and the wall portion 16, as the free edge 11. This type of wall arrangement also prevents the occurrence of strong turbulence of the type shown in FIG. 1.

FIG. 3 also shows that the wall 18 of the tank 4 opposite the wall portion 17 is sloped so as to be parallel to the latter so that, over a major part (i.e. more than 50%) of the height of the tank, the horizontal cross-sectional area of the tank is uniform. This ensures that the downward current in the flotation tank 4 is highly uniform and is free from local acceleration or retardation. The wall portion 17 is at about 60° to the bottom wall of the tank 4. As FIG. 3 shows, the bottom of the tank 4 slopes downwardly for a short distance from the wall portion 17 and then slopes upwardly gradually to the outlet 5.

With the construction of FIG. 3, it has been found that the floating layer contains virtually all the flocculated material and is little affected by the subsequent liquid flow. The layer readily becomes stable, as a result of which the dry solids content at its upper side may be markedly higher than is usual with systems previously known.

What is claimed is:

1. Apparatus for the flotation of flocculated solid material in a liquid, comprising (a) an upward flow passage arranged for upward flow of the liquid bearing the flocculated solid material ready for flotation, (b) a flotation tank adjacent said upward flow passage and arranged to receive the flow of liquid from the upward flow passage and to allow the flocculated material to collect at the liquid surface ready for collection (c) a side wall of said upward flow passage on the side thereof towards said flotation tank, which wall has an upper edge portion ending in a free edge, the said edge portion being curved over towards the flotation tank so as to provide a weir which in use of the apparatus is submerged below the liquid surface and over which the liquid flows from the said upward flow passage into the flotation tank, and (d) a side wall of the flotation tank on the side thereof towards the upward flow passage, which wall is generally spaced from the said side wall of the upward flow passage while joining the side wall of the upward flow passage at a region thereof away from said free edge, the said side wall of the flotation tank having a portion which slopes downwardly in the direction away from the upward flow passage and whose upper edge is, as seen in plan view, spaced inwardly of the flotation tank relative to said free edge.

2. In apparatus for the flotation of flocculated solid material in a liquid, comprising an upward flow passage arranged for upward flow of liquid carrying the solid material and a flotation tank adjacent thereto, the said upward flow passage having, on its side towards the flotation tank, a side wall whose upper end portion is curved over towards the flotation tank and ends at a free edge so as to form a weir which in use is submerged in the liquid and over which the liquid passes from the said upward flow passage to the flotation tank, the improvement that, the flotation tank has, on its side towards the said upward flow passage, a side wall which is generally spaced from the said side wall of the said upward flow passage but joins that wall at a region thereof away from said free edge, the said side wall of the flotation tank having a portion which slopes downwardly in the direction away from the said upward passage, the upper edge of said sloping portion being, as seen in plan view, spaced inwardly of the flotation tank with respect to the said free edge.

3. Apparatus according to claim 2 wherein the said sloping portion of the wall of the flotation tank is at an angle of about 60° to the base wall of the tank and its said upper edge is horizontally spaced from the said wall of the upwards flow passage by a distance equal to about twice the horizontal width, in the direction from the upward flow passage to the flotation tank, of the said curved upper end portion of the wall of the upward flow passage.

4. Apparatus according to one of claims 2 and 3 wherein the flotation tank has, over at least a major part of its depth, a substantially constant horizontal cross-sectional area.

* * * * *